US006332762B1

(12) United States Patent
Tsukamoto

(10) Patent No.: US 6,332,762 B1
(45) Date of Patent: Dec. 25, 2001

(54) SCROLL-TYPE FLUID DISPLACEMENT APPARATUS

(75) Inventor: Ko Tsukamoto, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/616,051

(22) Filed: Jul. 13, 2000

(30) Foreign Application Priority Data

Jul. 16, 1999 (JP) ..... 11-203719

(51) Int. Cl.[7] ..... F01C 1/02
(52) U.S. Cl. ..... 418/55.1; 418/55.2; 418/55.6
(58) Field of Search ..... 418/55.1, 55.2, 418/55.6

(56) References Cited

U.S. PATENT DOCUMENTS

| | | | | |
|---|---|---|---|---|
| 4,382,754 | | 5/1983 | Shaffer et al. . | |
| 4,490,099 | | 12/1984 | Terauchi et al. . | |
| 4,547,137 | | 10/1985 | Terauchi et al. . | |
| 4,627,800 | | 12/1986 | Matsudaira et al. . | |
| 5,037,279 | | 8/1991 | Suefuji et al. . | |
| 5,059,102 | | 10/1991 | Tokumitsu et al. . | |
| 5,252,046 | * | 10/1993 | Wen-Ding et al. | 418/55.6 |
| 5,370,512 | | 12/1994 | Fujitani et al. . | |
| 5,427,513 | * | 6/1995 | Yamada et al. | 418/55.2 |
| 5,494,422 | * | 2/1996 | Ukai et al. | 418/55.6 |
| 5,580,228 | | 12/1996 | Ishikawa et al. . | |
| 5,593,295 | * | 1/1997 | Hill | 418/55.2 |
| 5,678,986 | * | 10/1997 | Terauchi et al. | 418/55.6 |
| 5,944,500 | | 8/1999 | Iizuka . | |

FOREIGN PATENT DOCUMENTS

| | | | | |
|---|---|---|---|---|
| 0106288 | | 4/1984 | (EP) . | |
| 0761971 | | 3/1997 | (EP) . | |
| 2161218 | | 1/1986 | (GB) . | |
| 57148088 | | 9/1982 | (JP) . | |
| 58172405 | | 10/1983 | (JP) . | |
| 59079090 | | 5/1984 | (JP) . | |
| 01-130081-A | * | 5/1989 | (JP) | 418/55.6 |
| 01130083 | | 5/1989 | (JP) . | |
| 02-067485-A | * | 3/1990 | (JP) | 418/55.1 |
| 03-249388-A | * | 11/1991 | (JP) | 418/55.2 |
| 04350378 | | 12/1992 | (JP) . | |
| 106568 | | 4/1993 | (JP) . | |

OTHER PUBLICATIONS

U.S. application No. 08/877,896 filed on Jul. 18, 1997.

* cited by examiner

*Primary Examiner*—Thomas Denion
*Assistant Examiner*—Theresa Trieu
(74) *Attorney, Agent, or Firm*—Baker Botts L.L.P.

(57) ABSTRACT

A scroll-type fluid displacement apparatus includes an orbiting and fixed scroll members. The orbiting scroll member has a first end plate and a first spiral element extending from one side of the first end plate and the fixed scroll member has a second end plate and second spiral element extending from one side of the second end plate. A driving mechanism includes a drive shaft rotatably supported by the housing to effect the orbital motion of the orbiting scroll member by the rotation of the drive shaft to thereby change the volume of the fluid pockets. At least one of second side of the first end plate of the orbiting scroll member and the second end plate of the fixed scroll member has a recess portion having a plate thickness that is thinner than the rest of the respective end plate. As a result, the stress concentration of the orbiting scroll member and the fixed scroll member may be reduced, and the strength of the central part of end plates and spiral members may be increased. Therefore, the durability of the orbiting scroll member and the fixed scroll member of the fluid displacement apparatus may be increased.

6 Claims, 7 Drawing Sheets

SCROLL-TYPE FLUID DISPLACEMENT APPARATUS

BACKGROUND OF THE INVENTION

1. Field of the Invention

The present invention relates to a scroll-type fluid displacement apparatus, and more particularly, to a scroll-type fluid compressor having improved scroll members.

2. Description of Related Art

Scroll-type fluid displacement apparatus, which having a fixed scroll member and an orbiting scroll member, are known in the art. Referring to FIG. 5, a known scroll-type fluid displacement apparatus is shown in the form of scroll-type compressor unit 50. Compressor unit 50 includes cup-shaped casing 1, front housing 2, orbiting scroll member 10 and fixed scroll member 11. Front housing 2 is funnel-shaped and is fixed to the open side of cup shaped casing 1 by a plurality of screws (not shown).

Annular sleeve 2*a* projects from the center portion of front housing 2. Drive shaft 3 penetrates annular sleeve 2*a* and reaches the inside of cup-shaped casing 1. Drive shaft 3 is rotatably supported by annular sleeve 2*a* through bearings 4 and 5. Drive apparatus 6 is secured on the projecting part of drive shaft 3, which projects from front housing 2. Drive apparatus 6 comprises pulley 7 and electromagnetic clutch 8. An external driving force (not shown) rotates pulley 7, and a transmission device (not shown) transmits the driving force of the external driving force. Pulley 7 is rotatably supported by the projecting part of housing 2. Electromagnetic clutch 8 transmits a rotating force of pulley 7 to drive shaft 3, or disconnects a rotating force of pulley 7 from drive shaft 3.

Orbiting scroll member 10 and fixed scroll member 11 are disposed in cup-shaped casing 1. Fixed scroll member 11 is disposed in the bottom portion of cup-shaped casing 1, and orbiting scroll member 10, which interfits with fixed scroll member 11, is disposed in the open side of cup-shaped casing 1. Fixed scroll member 11 is secured on cup-shaped casing 1 by a plurality of screws 25, which thread from the outside of the bottom portion of cup-shaped casing 1.

Orbiting scroll member 10 comprises first end plate 13 and first spiral element 14, which is formed on first end plate 13. Orbiting scroll member 10 is eccentrically connected to drive shaft 3. Therefore, orbiting scroll member 10 is driven in an orbital motion by the rotation of drive shaft 3 in cup-shaped casing 1.

Fixed scroll member 11 comprises second end plate 16 and second spiral element 17, which is formed on second end plate 16. Discharge chamber 12 is defined by the bottom of the inner surface of cup-shaped casing 1 and second end plate 16. Discharge port 15 is formed in the central part of second end plate 16. Reed valve 20, which is plate-shaped, is formed to be movable on discharge port 15 between a closed position and an open position. Valve retainer 21 is formed on reed valve 20 to limit the open movement to a predetermined amount or degree.

Second end plate 16 isolates two chambers in cup-shaped casing 1, discharge chamber 12 and suction chamber 23. Orbiting scroll member 10 is disposed in suction chamber 23, which sucks refrigerant gas from the outside. First spiral element 14 of orbiting scroll 10 and second spiral element 17 of fixed scroll member 11 interfit at a predetermined angular offset.

The side wall part of cup-shaped casing 1 has inlet port 31, which sucks refrigerant gas, and outlet port 32, which discharges compressed fluid. Outlet port 32 communicates discharge chamber 12 with the outside of the compressor.

In this structure of a scroll-type fluid displacement apparatus, when a driving force is transmitted from an external drive source, e.g., an engine of a vehicle, via drive apparatus 6, drive shaft 3 is rotated, and orbiting scroll member 10 is driven in an orbital motion by the rotation of drive shaft 3. When orbiting scroll member 10 moves in an orbital motion, the fluid pockets, which are formed between fixed scroll member 11 and orbiting scroll member 10, move to the center with a consequent reduction in volume. Finally, the fluid pockets move to and are forced through discharge port 15, and open reed valve 20. The compressed fluid in the discharge chamber 12 is discharged into a refrigerant circuit (not shown) through outlet port 32 disposed on cup-shaped casing 1.

Bearing member space 19 is formed around bearing 4, which is disposed between drive shaft 3 and front housing 2. Bearing member space 19 communicates with fluid suction space side of orbiting scroll 10 through a hole formed in housing 2 (not shown). Balance weight 26 is fixed to orbiting scroll 10 through eccentric bush 27.

FIGS. 6*a* to 6*c* depict a plan, cross-sectional view of orbiting scroll member 10 of FIG. 5. Conventionally, first end plate 13 of orbiting scroll member 10 is formed with a uniform plate thickness throughout. As shown in FIG. 6*b*, in order to prevent cracks in the central end part of first spiral member 14, however, the plate thickness of the central part of first end plate 13 tends to be thicker than the rest of end plate 13. This is because the majority of the stress is concentrated at the collecting portion of the spiral wall of first spiral member 14 and first end plate 13. For example, a known scroll member is disclosed in Japanese Patent Application JP-A-5-106568.

FIGS. 7*a* to 7*c* depict a plan, cross-sectional view of fixed scroll 11 member of FIG. 5. Conventionally, second end plate 16 of fixed scroll 11 has a uniform thickness throughout.

In a known scroll-type fluid displacement apparatus, the plate thickness of the central part of first end plate 13 is thicker than the rest of end plate 13 in order to prevent cracks in the central end part of first spiral member 14. Therefore, there are problems with the increased weight of orbiting scroll member 10, which causes the weight of a scroll-type fluid apparatus to increase. It is difficult to reduce the weight of fixed scroll member 11, because second end plate 16 of fixed scroll 11 is formed with a uniform thickness. Therefore, it is difficult to reduce the weight of a scroll-type fluid apparatus.

SUMMARY OF THE INVENTION

An object of the present invention is to provide a scroll-type fluid apparatus, in which cracking in spiral members may be prevented by avoiding, or reducing, the concentration of stress in scroll members.

In an embodiment, a scroll-type fluid displacement apparatus comprises a housing and a fixed and an orbiting scroll and a driving mechanism. The housing has a fluid inlet port and a fluid outlet port. The orbiting scroll member has a first end plate and a first spiral element extending from one side of the first end plate. The fixed scroll member has a second end plate and a second spiral element extending from one side of the second end plate. The first spiral element and second spiral element interfit at an angular and a radial offset to form a plurality of line contacts defining at least one pair of sealed-off fluid pockets. The driving mechanism includes a drive shaft rotatably supported by the housing to effect the orbital motion of the orbiting scroll member by the rotation of the drive shaft to thereby change the volume of the fluid pockets. A second side of a central part of the first end plate of the orbiting scroll member has a recess portion having a plate thickness that is less than the rest of the first end plate.

In another embodiment, a scroll-type fluid displacement apparatus comprises a housing and a fixed and an orbiting scroll and a driving mechanism. The housing has a fluid inlet port and a fluid outlet port. The orbiting scroll member has a first end plate and a first spiral element extending from one side of the first end plate. The fixed scroll member has a second end plate and a second spiral element extending from one side of the second end plate. The first spiral element and second spiral element interfit at an angular and a radial offset to form a plurality of line contacts defining at least one pair of sealed-off fluid pockets. The driving mechanism includes a drive shaft rotatably supported by the housing to effect the orbital motion of the orbiting scroll member by the rotation of the drive shaft to thereby change the volume of the fluid pockets. A second side of a central part of the second end plate of the fixed scroll member has a recess portion having a plate thickness that is less than the second end plate.

The structure for a scroll-type fluid displacement apparatus according to this invention may prevent cracking in scroll members by avoiding, or reducing, the concentration of stress in scroll members. As a result, the structure of the present invention may improve the durability of scroll members.

Other objects, features, and advantages will be apparent to persons of ordinary skill in the art from the following description of the invention and the accompanying drawings.

BRIEF DESCRIPTION OF THE DRAWINGS

The present invention may be more readily understood with reference to the following drawings, in which.

DETAILED DESCRIPTION OF PREFERRED EMBODIMENTS

Several embodiments of the present invention are illustrated in FIGS. 1*a*–4*b* in which the same numerals are used to denote elements which correspond to similar elements depicted in FIGS. 5–7*c* and described above. A detailed description of components of a known scroll-type fluid displacement apparatus that may be common to a scroll-type fluid displacement apparatus of the present invention is omitted from the following description of preferred embodiments. Therefore, the following explanation of these embodiments focuses on the differences in the structure of these embodiments from those structures employed with respect to FIGS. 1*a*–4*b*.

Figure 1B:
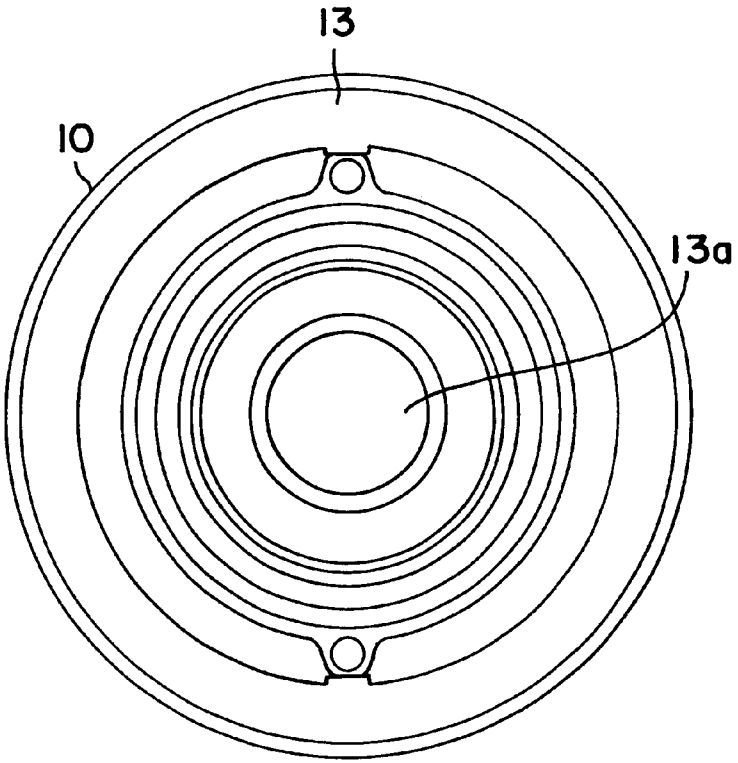
FIG. 1*b* is a plan, rear view of the orbiting scroll member of FIG. 1*a;*
Figure 1A:
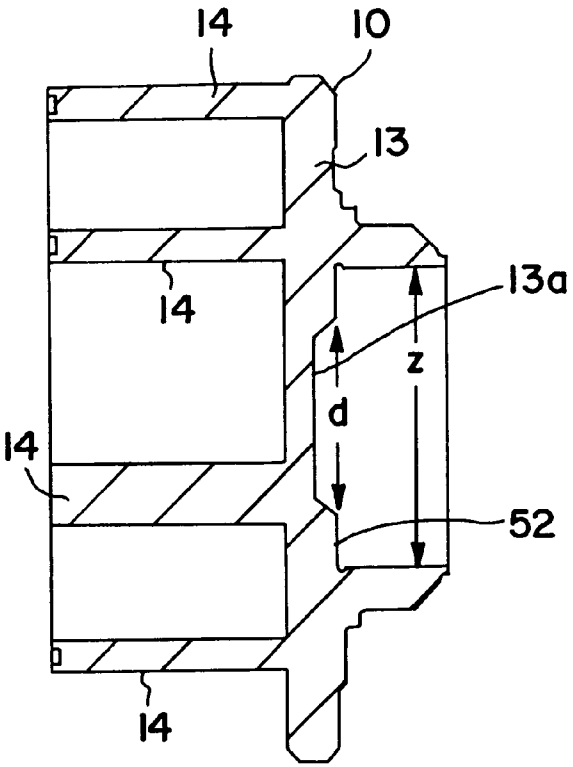
FIG. 1*a* is a longitudinal, cross-sectional view of an orbiting scroll member of a scroll-type fluid displacement apparatus in accordance with a first embodiment of the present invention.

Referring to FIGS. 1*a* and 1*b*, an orbiting scroll member in accordance with a first embodiment of the present invention is shown. First spiral member 14 is formed on a first side of first end plate 13. Recess portion 13*a*, having a diameter (d), is formed around the central part of spiral member 14 of orbiting scroll 10 on a second side of first end plate 13. The plate thickness of recess portion 13*a* of first end plate 13 is less than that of the rest of first end plate 13. To form recess portion 13*a*, a portion of first end plate 13 is removed from the second side of first end plate 13. In the first embodiment, although recess portion 13*a* has a cylindrical-shape, other shapes for recess portion 13*a* are within the contemplation of the present invention. Moreover, compressor unit 50 also comprises an annular boss portion 52 having an internal diameter (z), which projects from the second side of first endplate 13. Further, diameter (d) of recess portion 13*a* is less than internal diameter (z) of annular boss portion 52.

Figure 2B:
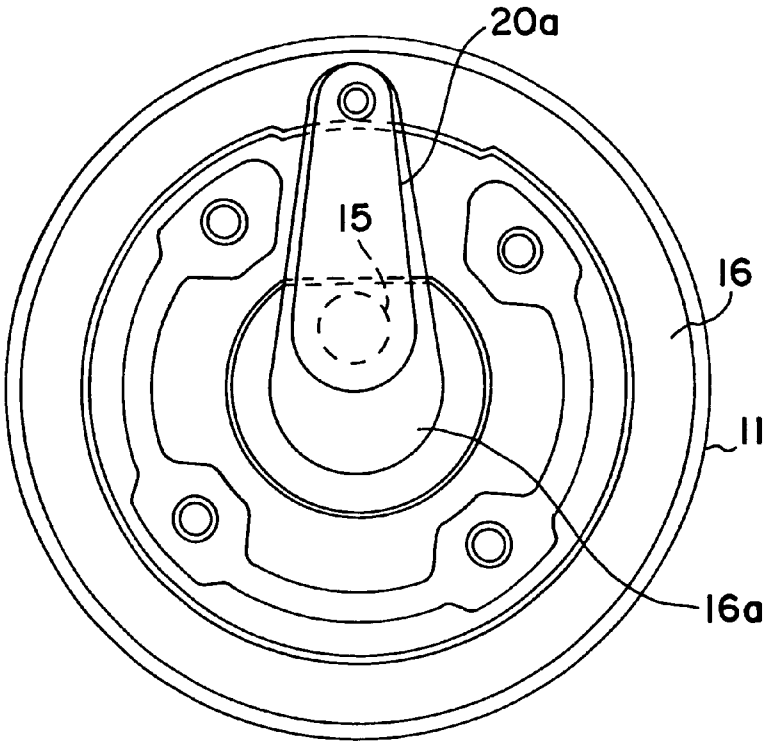
FIG. 2*b* is a rear view of the fixed scroll member of FIG. 2*a;*
Figure 2A:
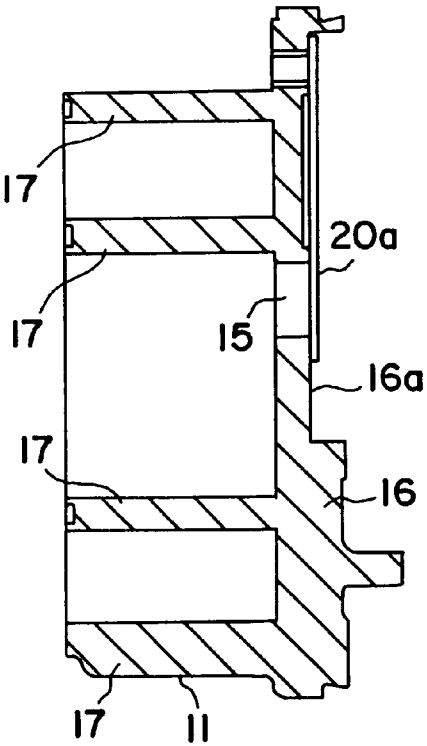
FIG. 2*a* is a longitudinal, cross-sectional view of a fixed scroll member of the scroll-type fluid displacement apparatus in accordance with a second embodiment of the present invention.

Referring to FIGS. 2*a* and 2*b*, a fixed scroll member in accordance with a second embodiment of the present invention is shown. Second spiral member 17 is formed on a first side of second end plate 16. Discharge port 15 is formed in the central part of second end plate 16 of fixed scroll member 11 in order to discharge compressed gas to discharge chamber 12, which is shown FIG. 5. Reed valve 20*a* is formed to be movable between a closed position and an open position, and is formed on a second side of second end plate 16 of fixed scroll 11, and regulates the discharge of compressed fluid through discharge port 15. Recess portion 16*a* is formed on the second side of second end plate 16, which includes reed valve 20*a*. Recess portion 16*a* of second end plate 16 is thinner than the rest of second end plate 16.

To form recess portion 16*a*, a portion of second end plate 16 is removed from the second side of second end plate 16. In the second embodiment, although recess portion 16*a* is wider than the shape of reed valve 20*a*, other shapes for recess portion 16*a* are within the contemplation of the present invention.

Figure 3B:
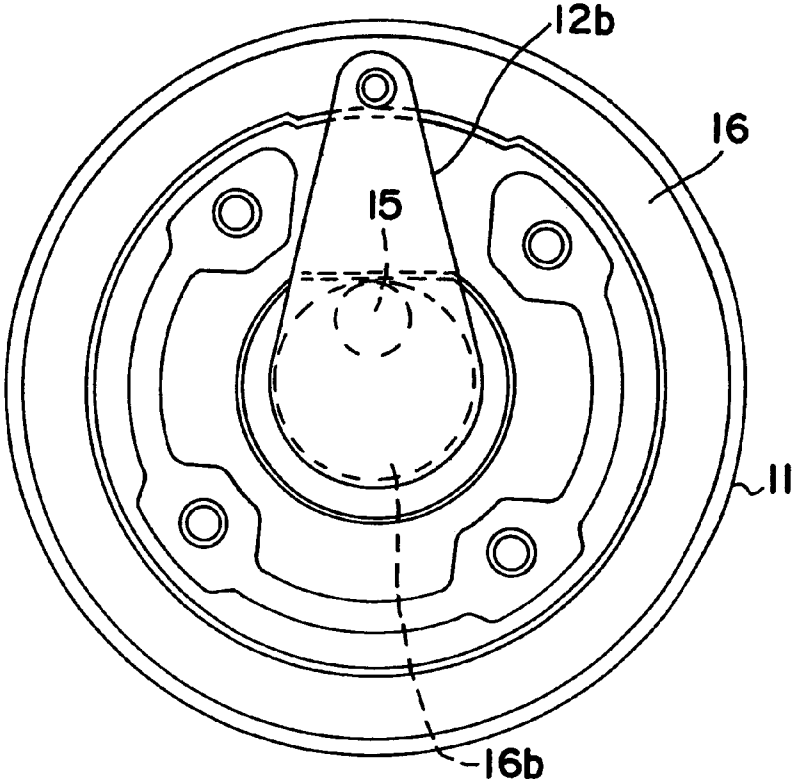
FIG. 3*b* is a rear view of the fixed scroll member of FIG. 3*a;*
Figure 3A:
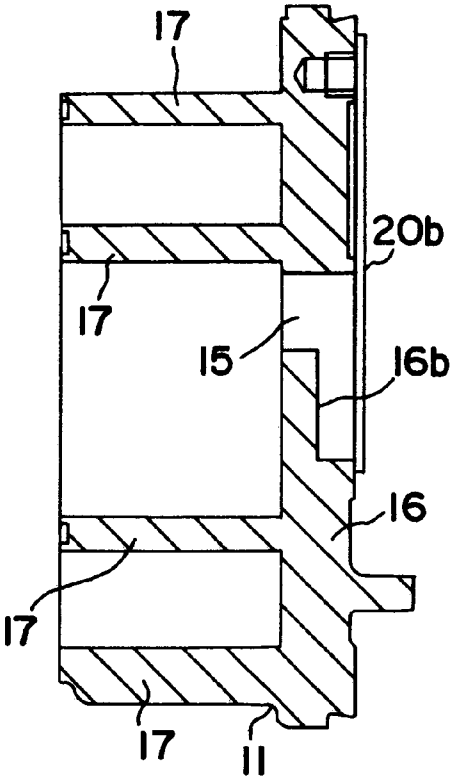
FIG. 3*a* is a longitudinal, cross-sectional view of a fixed scroll member of the scroll-type fluid displacement apparatus in accordance with a third embodiment of the present invention.

Referring to FIGS. 3*a* and 3*b*, a fixed scroll member in accordance with a third embodiment of the present invention is shown. Second spiral member 17 is formed on a first side of second end plate 16. Discharge port 15 is formed in the central part of second end plate 16 of fixed scroll 11 in order to discharge compressed gas to discharge chamber 12. Reed valve 20*b* is formed to be movable between a closed position and an open position, and is formed on a second side of second end plate 16 of fixed scroll member 11, and regulates the discharge of compressed fluid through discharge port 15. Recess portion 16*b* is formed on the second side of second end plate 16, and surrounds discharge port 15. Reed valve 20*b* is disposed against discharge port 15 and recess portion 16*b*, and covers discharge port 15 and recess portion 16*b*. Recess portion 16*b* of second end plate 16 is thinner than the rest of second end plate 16. To form recess portion 16*b*, a portion of second end plate 16 is removed from the second side of second end plate 16. In the third embodiment, although recess portion 16*b* is cylindrical-shape, other shapes for recess portion 16*b* are within contemplation of the present invention.

Figure 4B:
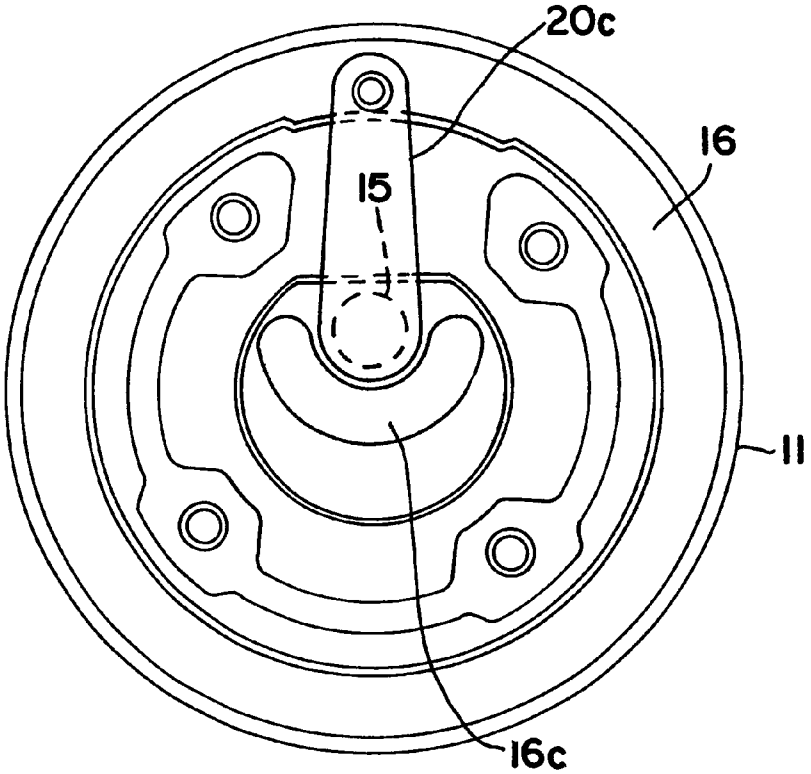
FIG. 4*b* is a rear view of the fixed scroll member of FIG. 4*a;*
Figure 4A:
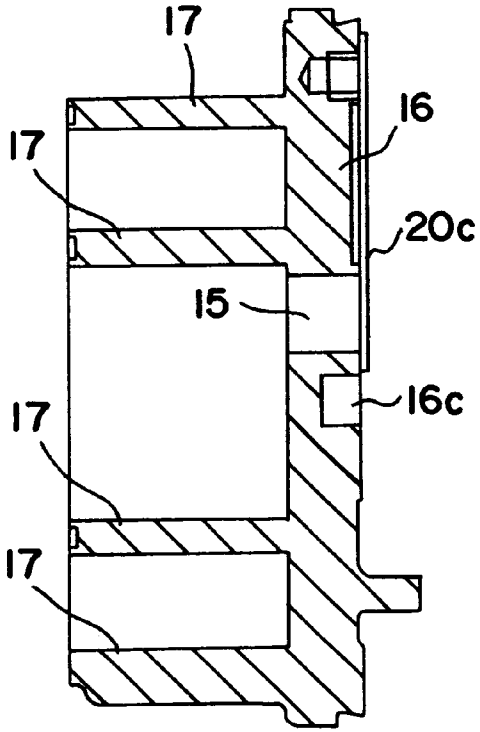
FIG. 4*a* is a longitudinal, cross-sectional view of a fixed scroll member of the scroll-type fluid displacement apparatus in accordance with a fourth embodiment of the present invention.
Figure 5:
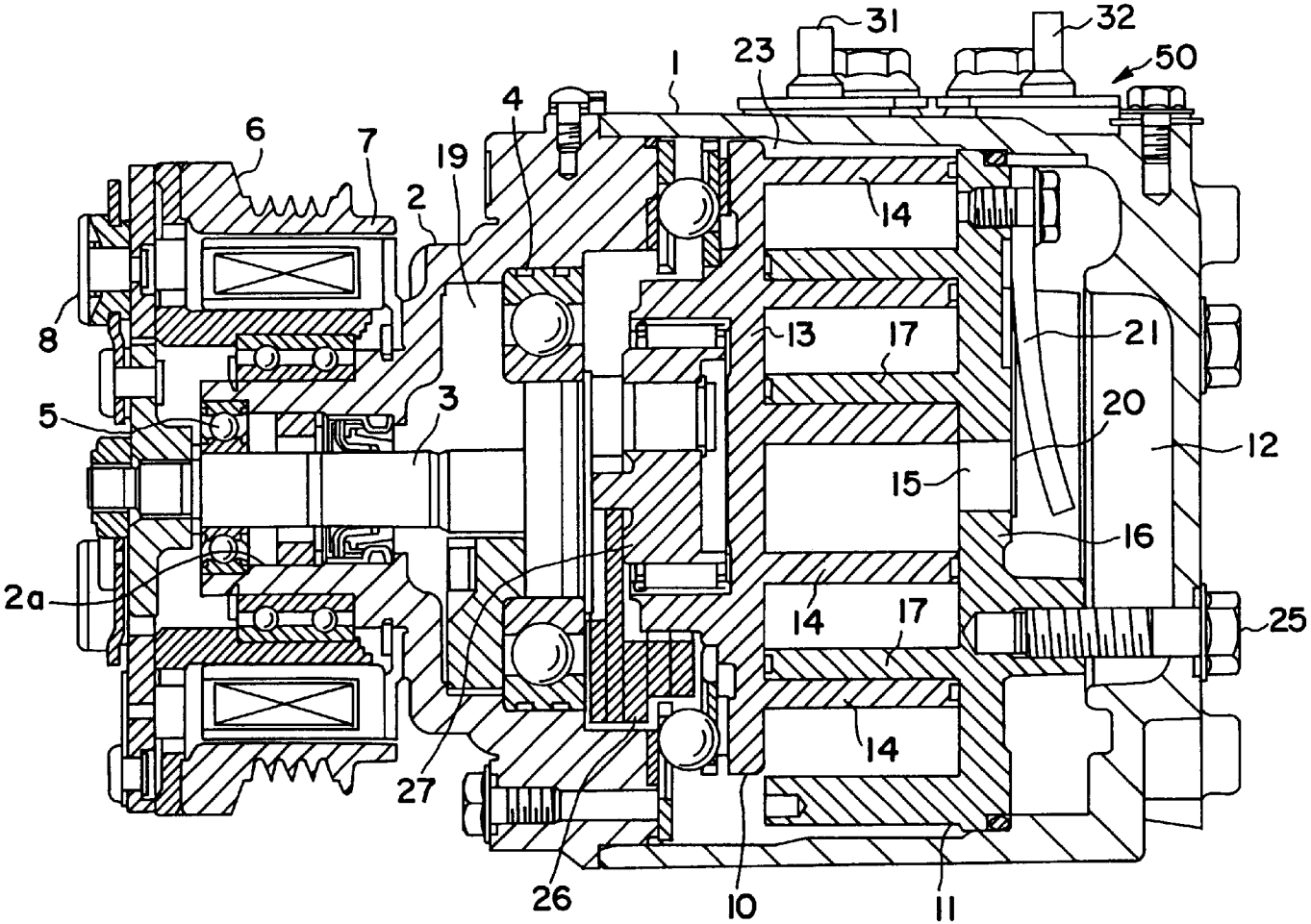
FIG. 5 PRIOR ART
FIG. 5 is a longitudinal, cross-sectional view of a known scroll-type fluid displacement apparatus.
Figure 6C:
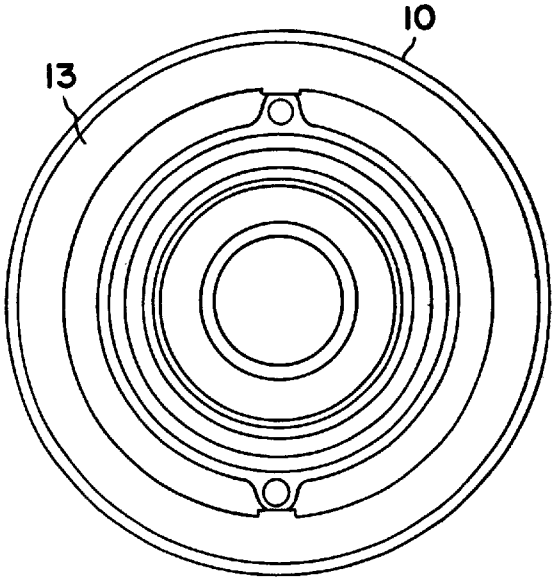
FIG. 6c PRIOR ART
FIG. 6*c* is a rear view of the known orbiting scroll member of FIG. 6*a;*
Figure 6B:
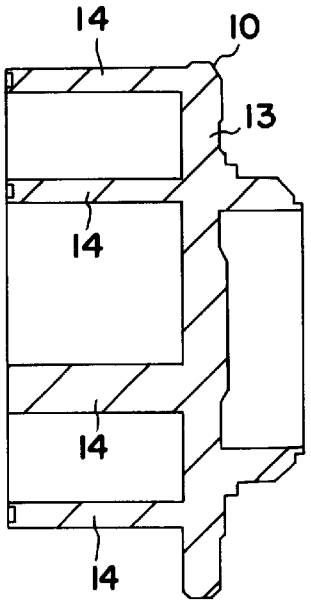
FIG. 6b PRIOR ART
FIG. 6*b* is a longitudinal, cross-sectional view of the known orbiting scroll member of FIG. 6*a;*
Figure 6A:
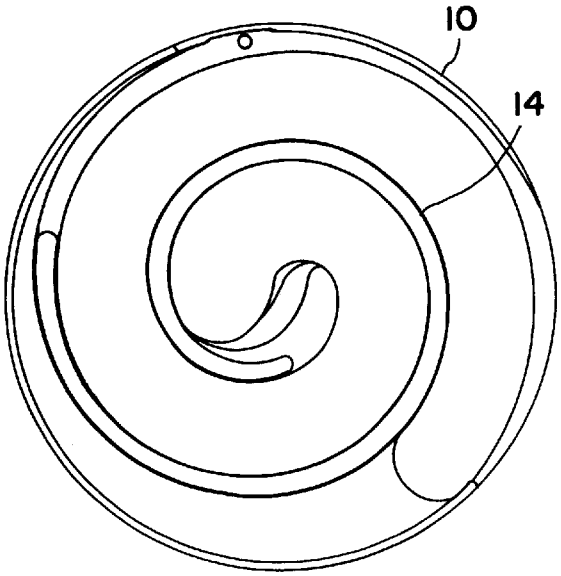
FIG. 6a PRIOR ART
FIG. 6*a* is a front view of a known orbiting scroll member of the known scroll-type fluid displacement apparatus.
Figure 7C:
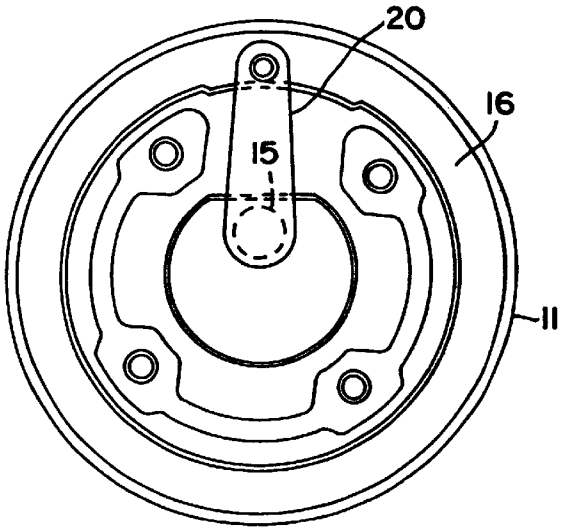
FIG. 7c PRIOR ART
FIG. 7*c* is a rear view of the known fixed scroll member of FIG. 7*a*.
Figure 7B:
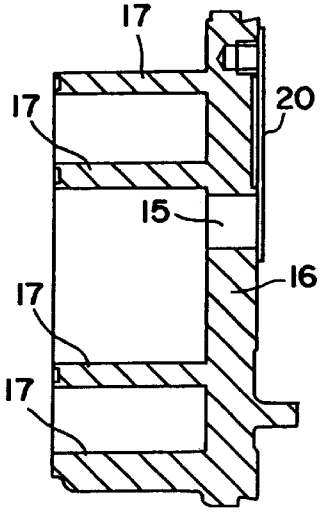
FIG. 7b PRIOR ART
FIG. 7b is a longitudinal, cross-sectional view of the known fixed scroll member of FIG. 7*a*.
Figure 7A:
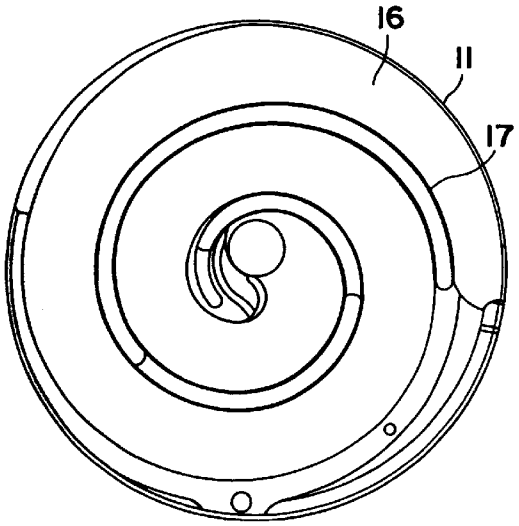
FIG. 7a PRIOR ART
FIG. 7*a* is a front view of a known fixed scroll member of the known scroll-type fluid displacement apparatus.

Referring to FIGS. 4*a* and 4*b*, a fixed scroll member in accordance with a fourth embodiment of the present invention is shown. Second spiral member 17 is formed on a first side of second end plate 16. Discharge port 15 is formed in the central part of second end plate 16 of fixed scroll 11 in order to discharge compressed gas to discharge chamber 12. Reed valve 20*c* is formed to be movable between a closed position and an open position, and is formed on a second side of second end plate 16 of fixed scroll 11, and regulates the discharge of compressed fluid through discharge port 15. Recess portion 16*c* is formed on the second side of second end plate 16 and is next to discharge port 15. Reed valve 20*c* is disposed against discharge port 15. Recess portion 16*c* of second end plate 16 is thinner than the rest of second end plate 16. To form recess portion 16*c*, a portion of second end plate 16 is removed from second side of second end plate 16. In the fourth embodiment, recess portion 16*c* has an arc shape along the curved surface of a tip portion of reed valve 20*c* so as not to affect the operation of reed valve 20*c*.

As described above, the plate thickness around the central part of end plates and the central end part of spiral members of scroll members are less than that of known plates for scroll members. Therefore, the stress concentration of the orbiting scroll member and the fixed scroll member may be reduced, and the strength of the central part of end plates may be increased. Normally, cracks in the spiral members occur near the central end part of the spiral member. However, the structure of the present invention may improve the durability of the spiral member because the maximum stress value around the central part of the spiral member is reduced. As a result, the structure of the present invention may provide increased strength for scroll members, and it may improve the durability of scroll members. Further, the structure of the present invention may reduce the weight of scroll members and the overall weight of the scroll-type fluid displacement apparatus.

Although the present invention has been described in connection with preferred embodiments, the invention is not limited there to. It will be understood by those skilled in the art that variations and modifications may be made within the scope and spirit of this invention, as defined by the following claims.

What is claimed is:

1. A scroll-type fluid displacement apparatus comprising:

a housing having a fluid inlet port and a fluid outlet port;

an orbiting scroll member having a first end plate and a first spiral element extending from one side of said first end plate;

a fixed scroll member having a second end plate and a second spiral element extending from one side of said second end plate, said first spiral element and second spiral element interfitting at an angular and a radial offset to form a plurality of line contacts defining at least one pair of sealed-off fluid pockets;

a driving mechanism including a drive shaft rotatably supported by said housing to effect the orbital motion of said orbiting scroll member by the rotation of said drive shaft to thereby change the volume of said fluid pockets, and an annular boss projecting from a second side of said first end plate, said annular boss having an internal diameter, wherein said second side of said first end plate has a recess portion having a diameter less than said internal diameter of said annular boss.

2. A scroll-type fluid displacement apparatus comprising:

a housing having a fluid inlet port and a fluid outlet port;

an orbiting scroll member having a first end plate and a first spiral element extending from one side of said first end plate;

a fixed scroll member having a second end plate and a second spiral element extending from one side of said second end plate, said first spiral element and second spiral element interfitting at an angular and a radial offset to form a plurality of line contacts defining at least one pair of sealed-off fluid pockets;

a driving mechanism including a drive shaft rotatably supported by said housing to effect the orbital motion of said orbiting scroll member by the rotation of said drive shaft to thereby change the volume of said fluid pockets, and an annular boss projecting from a second side of said first end plate, said annular boss having an internal diameter, wherein said second side of said first end plate has a recess portion having a diameter less than said internal diameter of said annular boss, and a second side of said second end plate has a recess portion.

3. A scroll-type fluid displacement apparatus comprising:

a housing having a fluid inlet port and a fluid outlet port;

an orbiting scroll member having a first end plate and a first spiral element extending from one side of said first end plate;

a fixed scroll member having a second end plate and a second spiral element extending from one side of said second plate, said first spiral element and second spiral element interfitting at an angular and a radial offset to form a plurality of line contacts defining at least one pair of sealed-off fluid pockets; and a driving mechanism including a drive shaft rotatably supported by said housing to effect the orbital motion of said orbiting scroll member by the rotation of said drive shaft to thereby change the volume of said fluid pockets, wherein a second side of said second end plate has a recess portion.

4. The scroll-type fluid displacement apparatus of claim 3, further comprising:

a discharge port formed in a central part of said second end plate; and a reed valve movable between a closed position and an open position, said reed valve located in the recess portion on said second end plate and regulating the flow of fluid through said discharge port.

5. The scroll-type fluid displacement apparatus claim 3, further comprising:

a discharge port formed in a central part of said second end plate; and a reed valve movable between a closed position and an open position, said discharge port surrounded by the recess portion, said reed valve located on said second end plate and regulating the flow of fluid through said discharge port.

6. The scroll-type fluid displacement apparatus of claim 3, further comprising:

a discharge port formed in a central part of said second end plate; and a reed valve movable between a closed position and an open position, said discharge port next to the recess portion, said reed valve located on said second end plate and regulating the flow of fluid through said discharge port.

* * * * *